US005124219A

United States Patent [19]

Shintani et al.

[11] Patent Number: 5,124,219

[45] Date of Patent: Jun. 23, 1992

[54] PHOTOSENSITIVE MEMBER FOR ELECTROPHOTOGRAPHY COMPRISING SPECIFIED NYLON COPOLYMER

[75] Inventors: Yuji Shintani; Tetsuo Kyogoku; Toshikazu Suzuki; Masamitsu Ishiyama, all of Osaka, Japan

[73] Assignee: Minolta Camera Kabushiki Kaisha, Osaka, Japan

[21] Appl. No.: 493,364

[22] Filed: Mar. 14, 1990

[30] Foreign Application Priority Data

Mar. 15, 1989 [JP] Japan ..... 1-62709

[51] Int. Cl.[5] ..... G03G 5/14

[52] U.S. Cl. ..... 430/66; 430/67

[58] Field of Search ..... 430/66, 67

[56] References Cited

U.S. PATENT DOCUMENTS 4,952,473 8/1990 Suzuki ..... 430/67

FOREIGN PATENT DOCUMENTS 78331 7/1976 Japan ..... 430/66

30846 2/1982 Japan ..... 430/66

*Primary Examiner*—Roland Martin

*Attorney, Agent, or Firm*—Burns, Doane, Swecker & Mathis

[57] ABSTRACT

This invention relates to a photosensitive member for electrophotography with a photoconductive layer on an electrically conductive substrate and a surface protective layer on the photoconductive layer, wherein the surface protective layer comprises a ternary polymer of nylon or a multicomponent polymer of nylon having 10% or less in saturated degree of water absorption under 65% of relative humidity at 24° C. The surface protective layer may have protuberances and hollows thereon. The surface protective layer may further comprises an inorganic layer on the photoconductive layer.

6 Claims, 4 Drawing Sheets

Saturated degree of water absorption of nylon copolymer (%)

PHOTOSENSITIVE MEMBER FOR ELECTROPHOTOGRAPHY COMPRISING SPECIFIED NYLON COPOLYMER

BACKGROUND OF THE INVENTION

This invention relates to a photosensitive member for electrophotography, more particularly comprising a specified nylon copolymer.

There is known a conventional photosensitive member for electrophotography constituted of a surface protective layer and a photoconductive layer on an electrically conductive substrate in the order.

The surface protective layer functions to prevent the photoconductive layer from being deteriorated by abrasion in a cleaning process, ozone ($O_3$), or nitrogen oxides ($NO_x$) which are produced by corona discharge.

For example, Japanese Patent Laid-open No. 57-204559 discloses a photosensitive member for electrophotography in which a surface protective layer prepared with a polyester amide-containing insulating resin is formed on a photoconductive layer. The polyester amide contained in the surface protective layer is a copolymer of an ester unit represented by the chemical formula (I) or (II) below with an amide unit represented by the chemical formula (III) or (IV) below: The copolymerization ratio (ester unit /amide unit) is 20/80-85/15.

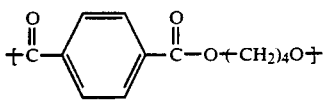

(I)

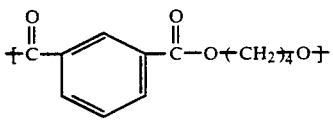

(II)

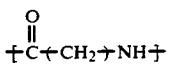

(III)

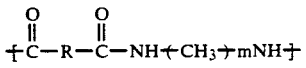

(IV)

There is also known a surface protective layer formed of ceramics such as $Al_2O_3$, $ZrO_2$, amorphous carbon and the like or metallic materials in consideration of wearing resistance with respect to durability, stability for electrostatic properties or the like.

Polyester amide used for the formation of the surface protective layer as above mentioned is made soluble in a solvent by controlling its crystallinity. However, its solubility is not sufficient from the view point of workability for coating. The ester component causes the lack in humidity resistance and wearing resistance, resulting in copied image flows and wear of the surface protective layer. Moreover, the surface protective layer containing the ester components has high electrical resistance to cause the accumulation of residual potential, resulting in the formation of fogs and nonuniform copied images.

The surface protective layer formed of ceramics or metallic materials is poor in its adhesivity to a photoconductive layer, resulting in the generation of cracks in the surface protective layer. Therefore, it does not exhibit sufficient durability with respect to the copy.

SUMMARY OF THE INVENTION

The object of the invention is to provide a photosensitive member with a surface protective layer which is improved in humid resistance and wearing resistance and lowered in residual potential to improve durability without the deterioration of copied image quality. The present invention relates to a photosensitive member for electrophotography with a photoconductive layer on an electrically conductive substrate and a surface protective layer on the photoconductive layer, wherein the surface protective layer comprises a ternary polymer of nylon or a multicomponent polymer of nylon having 10% or less in saturated degree of water absorption under 65% of relative humidity at 24 ° C.

DETAILED DESCRIPTION OF THE INVENTION

Figure 1:
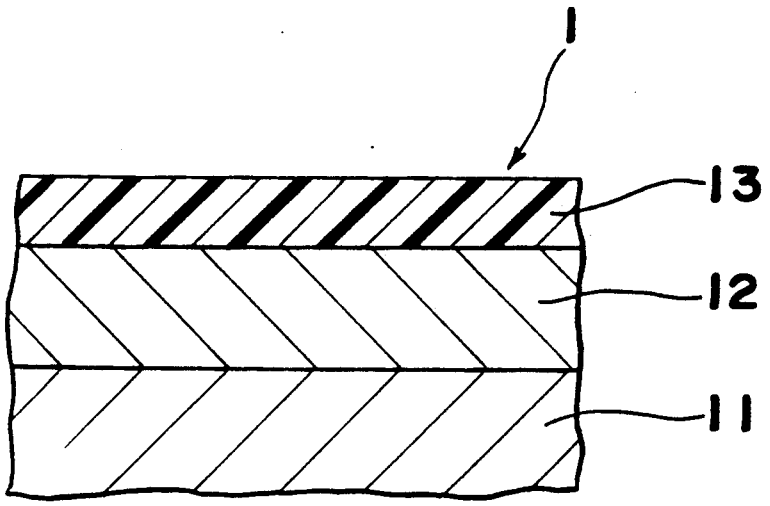
FIG. 1 shows a sectional view of a photosensitive member comprising a photoconductive layer on an electrically conductive substrate and a surface protective layer on the photoconductive layer.

The present invention provides a photosensitive member with a surface protective layer which is improved in humid resistance and wearing resistance and lowered in residual potential to improve durability without the deterioration of copied image quality.

The present invention has accomplished the above object by forming a surface protective layer with a specified nylon copolymer on a photoconductive layer. The surface protective layer may be irregular and may be constituted two layers.

First, the present invention provides a photosensitive member for electrophotography with a photoconductive layer on an electrically conductive substrate and a surface protective layer on the photoconductive layer.

The surface protective layer is composed of nylon copolymer, that is, ternary nylon polymer or a multicomponent nylon copolymer comprising at least 6-nylon component and 66-nylon component. The nylon copolymer is 10% or less in saturated degree of water absorption under 65% of relative humidity at 24 ° C.

The first invention effects humidity resistance wear resistance, decrease of residual potential. Therefore, the durability of the photosensitive member can be achieved without the deterioration of copied image quality. In the present invention, the nylon copolymer is represented by "nylon 6/66/L/M", wherein nylon 6 is the monomer unit represented by $$-CO(CH_2)_5NH-,$$

nylon 66 is the monomer unit represented by $$-CO(CH_2)_4CONH(CH_2)_6NH-$$

and L and M are monomer unit other than nylon 6 and nylon 66.

The monomer unit of L or M is exemplified by nylon 610: $-CO(CH_2)_8CONH(CH_2)_6NH-$
nylon 11; $-(CH_2)_{10}CONH-$
nylon 12; $-(CH_2)_{11}CONH-$
nylon 7: $-(CH_2)_6CONH-$
nylon 9: $-(CH_2)_8CONH-$
bis(4-aminocyclohexyl)methane 6:

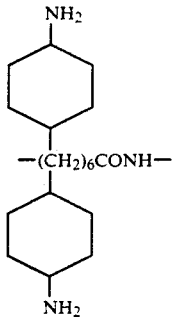

Nylon copolymers of the present invention are prepared by copolymerizing three or more kinds of monomers including at least a monomer of nylon 6, a monomer of nylon 66. Thereby, the nylon copolymers can dissolve easily in a highly polar solvent, such as alcohols, chloroform, DMF, water or the like. Hygroscopicity is low. Those properties can not be obtained in homopolymers, such as nylon 6, nylon 66 and the like.

The nylon copolymers are improved in light-transmittance because of its low crystallinity and being excellent in coating properties. Therefore, the nylon copolymers of the present invention are suitable for a surface layer of a photosensitive member.

Nylon copolymers "6/66/L/M . . . ", may have side chains, function groups such as hydroxy group and the like, aromatic rings, heterocyclic rings and the like in the main chains in consideration of solubility, hygroscopicity, electrophotographic properties.

Nylon copolymers are 0.5–10% in saturated degree of water absorption under 65% of relative humidity at 24 ° C. (measured according to JIS K 6810). Preferable nylon copolymers are 1.0–8% in saturated degree of water absorption under 65% of relative humidity at 40 ° C. If the saturated degree of water absorption under 65% of relative humidity at 24 ° C. is more than 10%, copied images may become poor in resolving power and the flows of copied images come to appear. If it is less than 0.5%, residual potential becomes high and fogs may come to appear on the ground.

Figure 6:
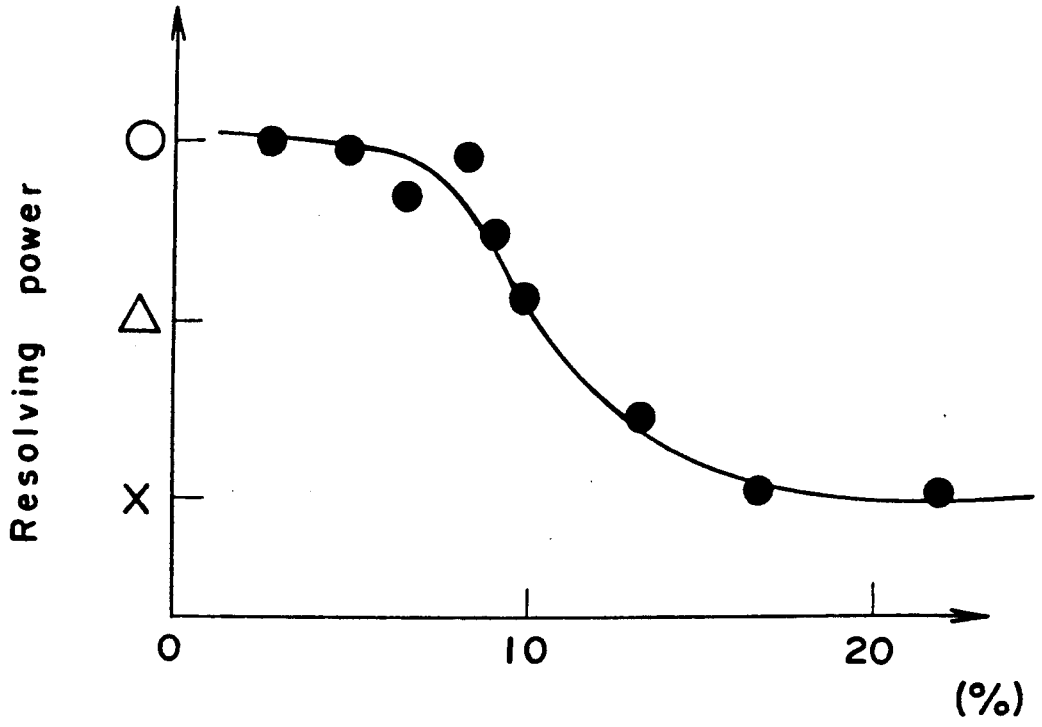
FIG. 6 is a graph showing the relation between resolving power and saturated degree of water absorption.

The relation between the resolving power and the saturated degree of water absorption is shown in FIG. 6, In FIG. 6, the symbol "o" means 6.3 lines/mm or less in resolving power, "Δ " means 5.0–6.3 lines/mm and "x" means less than 5.0 lines/mm. It is understand that the resolving power becomes poorer when the saturated degree of water absorption is more than 10%.

A surface protective layer is formed by coating a solution of nylon copolymers dissolved in a solvent on a photoconductive layer. In order to improve wear resistance and electrophotographic properties of the surface protective layer, curing agents, which are used for curing melamine resins, epoxy resins, isocyanate resins and the like, may be added in the coating solution to cross-link copolymer nylons. Without the use of the curing agent, nylon copolymers may be self-condensed by heat for curing.

In order to strain residual potential of photosensitive members, inorganic particles may be added or dispersed in nylon copolymers to adjust the electrical resistance of the surface protective layer. Such inorganic particles are exemplified by alumina, zirconia, yttria spinel ($MgO.Al_2O_3$), mullite ($3Al_2O_3 \cdot 2SiO_2O$) titania, silicon carbide, magnesium carbide, zinc oxide, silicon nitride, tungsten carbide, boron nitride and the like.

A surface protective layer may be formed by a known method, such as a dipping coating method, a spray coating method, a spinner coating method, a blade coating method, a roller coating method, a wire-bar coating method, or the like.

The surface protective layer is formed so that a thickness thereof may be 0.1–10 μm, preferably 0.5–5 μm. If the surface protective layer is thinner than 0.1 μm, the strength of the surface protective layer is lowered and a photoconductive layer is liable to be damaged. If the surface protective layer is thicker than 10 μm, light-transmittance is lowered, irradiation lights can hardly reach photoconductive layer, sensitivity is deteriorated, and residual potential is liable to increase.

A photoconductive layer may be mono-layer types composed of inorganic photoconductive materials, such as Se, Se-As alloys, Se-Te alloys, CdS, ZnO, a-Si and the like or organic photoconductive materials, such as polyvinylcarbazoles (PVK), phthalocyanines, trinitrofluorenones (TNF), bisazo pigments, hydrozones and the like, being deposited or dispersed in a binder resin, or function divided and laminated types composed of a charge generating layer and a charge transporting layer. Particular limitation is not given to kinds of the photoconductive layer.

The second invention is a photosensitive member for electrophotography with a photoconductive layer on an electrically conductive substrate and a surface protective layer on the photoconductive layer, wherein the surface protective layer comprises;

a first layer comprising ternary nylon copolymer, or a multicomponent nylon copolymer containing at least 6-nylon component and 6,6-nylon component, the nylon copolymer being 10% or less in saturated degree of water absorption under 65% of relative humidity at 24 ° C., and a second layer formed on the first layer comprising inorganic compounds.

The second invention effects humidity resistance, wear resistance and decrease of residual potential. The first layer prevents the second layer from cracking, thereby the durability with respect to copy can be much improved.

The first layer may be the same as the surface protective layer of the first invention explained above, except that a thickness of the first layer is 0.05–2.0 μm, preferably 0.1 μm–to 1.0 μm. If the layer is thinner that 0.05 μm, its adhesivity is lowered because of the formation of pin holes and noncoated portions, thereby, the durability becomes poor If the layer is thicker than 2.0 μm, residual potential is liable to increase, and that the surface hardness may be influenced by the first layer.

The inorganic materials used for the formation of the second layer are exemplified by metallic oxides, such as $ZrO_2$, $SiO_2$, $Ti_2$, $Ta_2O_5$, $CeO_2$, $Al_2O_3$and the like, nitrides, such as SiN, CrN, BN and the like and carbides, such as SiC and the like. The electrical volume resistance of the second layer formed thereof is preferably $10^9$ μm or higher. If the electric resistance is lower that $10^9$ μm, the photosensitive member is not charged sufficiently and such materials are not suitable for a surface protective layer of a photosensitive member. μm, preferably 0.3–1.5 μm. If the thickness is thinner than 0.05 μm, its durability is reduced. If the thickness is thicker than 2.0 μm, clacks are liable to generate, and residual potential is liable to increase, and manufacturing of this layer may put in a comparatively long time.

The second layer may be formed by, for example, a vacuum deposition method, a sputtering method, a PVD method, such as plasma CVD method, or a CVD method. The second layer may be treated by heat after its formation.

The third invention is a photosensitive member for electrophotography with a photoconductive layer on an electrically conductive substrate and a surface protective layer on the photoconductive layer, wherein the surface protective layer comprises ternary nylon copolymer or a multicomponent nylon copolymer containing at least 6-nylon component and 6,6-nylon component, the nylon copolymer being 10% or less in saturated degree of water absorption under 65% of relative humidity at 24 ° C. and the surface protective layer has hollows and protuberances thereon of 0.03–0.30 μmin average roughness. The third invention is different from the first invention in the hollows and protuberances of 0.03–0.3 μm in average roughness on the surface protective layer. The third invention is much improved in durability, In particular, the protuberances and follows effect improvement of wear resistance and decrease of revolution torque of the photosensitive member.

The hollows and protuberances may be formed by grinding directly the surface of the surface protective layer, or by forming surface protective layer on the irregular surface of a photoconductive layer, the irregularities being formed in advance before the surface protective layer is formed.

Abrasive grains used in the grinding process are exemplified by alumina, zirconium, diamond, titania, tungsten, carbide, a mixture thereof and the like. Abrasive grind wheels with the above described abrasive grains bound with a binder may be applied to the grinder for the grinding process. The size number of abrasive grains for grinding a surface protective layer may be selected from the range within #800–#40000 in consideration of desired size of protuberances and hollow.

Protuberances and hollows are formed so that average roughness may be 0.03–0.30 μm , preferably 0.04–0.10 μm. If the average roughness is less than 0.03 μm, the friction force between a surface protective layer and a cleaning member increases to lower the durability thereof. The cleaning member is also liable to warp. If the average roughness is more than 0.30 μm, toner particles, paper dusts are liable to gather in the hollows on the surface without being cleaned out.

Average roughness invention is the one measured according to JIS-B-0601 in the present invention.

The fourth invention is a photosensitive member for electrophotography with a photoconductive layer on an electrically conductive substrate and surface protective layer on the photoconductive layer, wherein the surface protective layer comprises;

a first layer comprising ternary nylon copolymer or a multicomponent nylon copolymer containing at least 6-nylon component and 6,6-nylon component, the nylon copolymer being 10% or less in saturated degree of water absorption under 65% of relative humidity at 24 ° C., and a second layer formed on the first layer comprising inorganic compounds. The second layer has hollows and protuberances thereon of 0.03–0.30 μm in average roughness.

The fourth invention is different from the second invention in the hollows and protuberances of 0.03–0.30 μm in average roughness formed on the second layer. The hollows and protuberances may be formed similarly as described in the third invention.

The fourth invention is much improved in durability. In particular, the protuberances and hollows effect improvement of wear resistance and decrease of revolution torque of the photosensitive member.

Specific examples are shown below with no significance in restricting the embodiments of the invention.

EXAMPLE 1

A photosensitive member for electrophotography (1) in this example concerns the first invention above described. The sectional view thereof is shown in FIG. 1. The photosensitive member is constituted of an electrically conductive substrate (11), a photoconductive layer (12) and a surface protective layer (13). The electrically conductive substrate is cylindrical and made of aluminium. The photoconductive layer (12) of 50–55 μm in thickness was formed on the electrically conductive substrate by depositing amorphous selenium-arsenic in vacuum at the level of $10^{-5}$ Torr in a known vacuum deposition vessel.

A surface protective layer(12) was formed as follows; a copolymer nylon 6/66/12 (AQ-Nylon K-80; made by Toray K.K.) was dissolved in a mixed solvent of methanol/toluene/water. The substrate with the photoconductive layer thereon was dipped in the above obtained solution to form the surface protective layer on the photoconductive layer (12) so that the thickness might be 1.5 μm after dried at 130 ° C. for 10 minutes. The volume resistance of the surface protective layer(13) was $10^{13}$ Ω cm. The saturated degree of water absorption of the used nylon copolymer was 2% in relative humidity of 65% at 24 ° C.

EXAMPLE 2

A photosensitive member for electrophotography in this Example is different from that in Example 1 in a photoconductive layer and a surface protective layer. The photoconductive layer is a two layer type, being constituted of a charge generating layer formed on an electrically conductive substrate and a charge transporting layer formed on the charge generating layer.

The charge generating layer was formed as follows;

| Ingredient | Parts by weight |
|---|---|
| α- type Copper-phthalocyanine represented by the following general formula (A) (made by Wako Junyaku Kogyo K.K.) | 30 |
| Polycarbonate resin (made by Teijin Kasei Kogyo K.K.) | 100 |
| Trichloroethane | 20 |

(A)

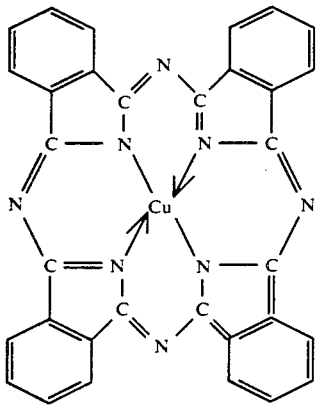

The above ingredients were dispersed by a sand mill at 1000 rpm for 10 minutes. The dispersion was diluted with trichloroethane. The substrate was dipped in the obtained solution to form the charge generating layer so that the thickness might be 0.3 μm after dried.

The charge transporting layer was formed as Ingredient Parts by weight

| Ingredient | Parts by weight |
|---|---|
| Hydrazone compound represented by the general formula (B) | 80 |
| Acrylic polyol resin (LR-1503; made by Mitsubishi Rayon K.K.) | 100 |
| Mixed solvent (toluene/ methyl ethyl ketone) | 80 |

(B)

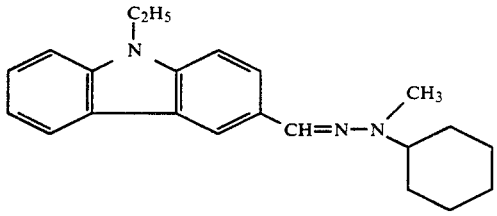

The above ingredients were stirred in a dissolver for 30 minutes to dissolve the hydrazone compound in the solvent. An isocyanate curing agent (Coronate; made by Nippon Poly urethane K.K.) of 2 parts by weight was added to the above obtained solution. The substrate with the charge generating layer thereon was dipped in the solution to form a charge transporting layer so that the thickness might be 16 μm after dried at 120 ° C. for 30 minutes.

The surface protective layer was formed as follows; a copolymer nylon 6/66/bis-(4-aminocyclohexyl) nylon 6 (BAS Ultramide) was dissolved in a mixed solvent of methanol/DMF/water (solids concentration of resin; 15% by weight). Melamine resin (Sumimal M-40S; made by Sumitomo Kagaku K.K. was added to the solution so that the solid concentration ratio thereof might be 20% by weight. The obtained solution was sprayed on the charge generating layer to form a surface protective layer of 2.0 μm in thickness after dried. The volume resistance of the surface protective layer was $10^{13}$ Ω cm. The saturated degree of water absorption of the used nylon copolymer was 1.5% in relative humidity of 65% at 25 ° C.

EXAMPLE 3

A photosensitive member for electrophotography in this Example is different from that in Example 1 only in a surface protective layer.

The surface protective layer was formed as follows; a copolymer nylon 6/66/12 (AQ-nylon K-80; made by Toray K.K.) was dissolved in a mixed solvent of methanol/toluene/water so that the solids concentration might by 15% by weight. The resin composition of epoxy resin (Dinacol EX 614B; made by Nagase Sangyo K.K.) and melamine resin (T34; made by Mitsui Toatsu K.K.) (the ratio of epoxy resin/melamine resin=4/1) was added to the solution as a curing agent so that the solids concentration ratio thereof might be 20% by weight.

The substrate with the photoconductive layer thereon was dipped in the above obtained solution to form the surface protective layer on the photoconductive layer (12) so that the thickness might be 2.5 μm after dried at 130 ° C. for 1 hour. The volume resistance of surface protective layer was $10^{13}$ Ω cm. The saturated degree of water absorption of the used nylon copolymer was 2% in relative humidity of 65% at 24 ° C.

EXAMPLE 4

A photosensitive member for electrophotography in this Example concerns the second invention above described.

Figure 2:
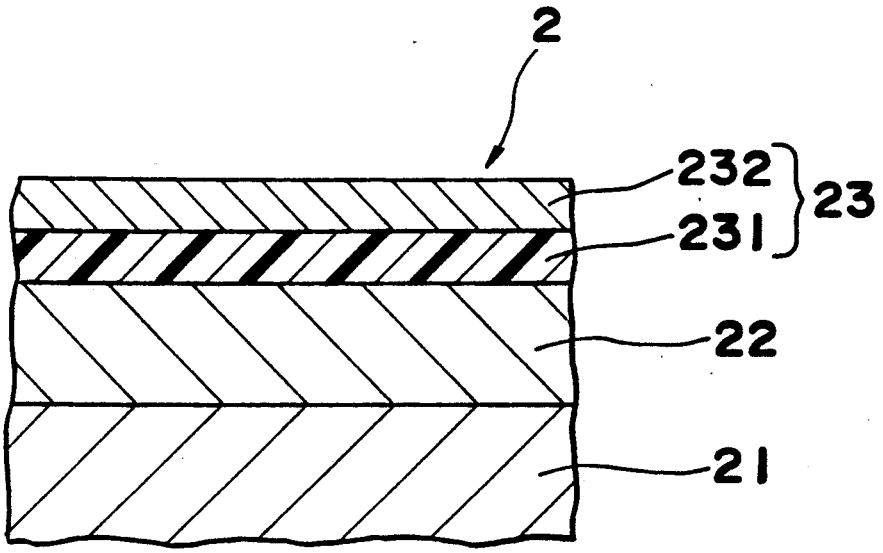
FIG. 2 shows a sectional view of a photosensitive member comprising a photoconductive layer on an electrically conductive substrate and a surface protective layer on the photoconductive layer, the surface protective layer comprising two layers.

The sectional view thereof is shown in FIG. 2. The photosensitive member is constituted of an electrically conductive substrate (21), a photoconductive layer (22), and a surface protective layer (23) constituted of a first layer (231) and a second layer (232). The electrically conductive substrate (21) and the photoconductive layer (23) are the same as those in Example 1. The first layer (231) of the surface protective layer (23) is the same as the surface protective layer (23) of Example 1, except that the layer thickness is 0.5 μm. The second layer (232) is a SiC layer of 0.5 μm in thickness formed by a high-frequency sputtering equipment (15 MHz) under atmosphere of He gas at 0.1 Torr.

EXAMPLE 5

A photosensitive member for electrophotography in this example is constituted of a photoconductive layer and a surface protective layer constituted of a first layer and a second layer, being different from that in Example 2 in that the second layer is formed. The second layer is formed by depositing $TiO_2$ in vacuum up to 1.0 μm in thickness.

EXAMPLE 6

A photosensitive member for electrophotography in this example is constituted of an electrically conductive substrate, a photoconductive layer and a surface protective layer constituted of a first layer and a second layer, being different from that of Example 4 only in the surface protective layer. The first layer of the surface protective layer was formed as follows; a copolymer nylon 6/66/12/ was dissolved in a mixed solvent of methanol/toluene/water so that the solids concentration might be 3% by weight. The resin composition of epoxy resin and melamine resin (epoxy resin/melamine resin=4/1) was added to the solution as a curing agent so that the solids concentration ratio thereof might 20% by weight.

The substrate with the photoconductive layer thereon was dipped in the above obtained solution to form the first layer of the surface protective layer so that the layer thickness might be 0.5 μm after dried at 130 ° C. for 1 hour. The second layer was a SiC layer of 0.5 μm in thickness formed by a high-frequency sputtering equipment (15 MHz) under atmosphere of He gas at 0.1 Torr.

EXAMPLE 7

A photosensitive member for electrophotography in this example is constituted of an electrically conductive substrate, a photoconductive layer and a surface protective layer constituted of a first layer and a second layer, being different from that of Example 6 only in the surface protective layer. The first layer of the surface protective was formed as follows; a copolymer nylon 6/66/610 (AQ-Nylon K-90; made by Toray K.K.) was dissolved in a mixed solvent of methanol/Diacetone alcohol/water, so that the solids concentration might be 15% by weight. The resin composition of epoxy resin (Dinacol EX 614B; made by Nagase Sangyo K.K.) and melamine resin (T34; made by Mitsui Toatsu K.K.) (epoxy resin/ melamine resin=4/1) was added to the solution as a curing agent so that the solids concentration ratio thereof might be 20% by weight.

The substrate with the photoconductive layer thereon was dipped in the above obtained solution to form the first layer of the surface protective layer so that the layer thickness might be 0.5 μm after dried at 130° C. for 1 hour. The second layer was an $Al_2O_3$ layer of 0.8 μm in thickness formed by ion-plating equipment of arcing type under conditions of 200 V in substrate voltage, 10 Å/sec in layer forming rate, 60° C. in substrate temperature.

EXAMPLE 8

Figure 3:
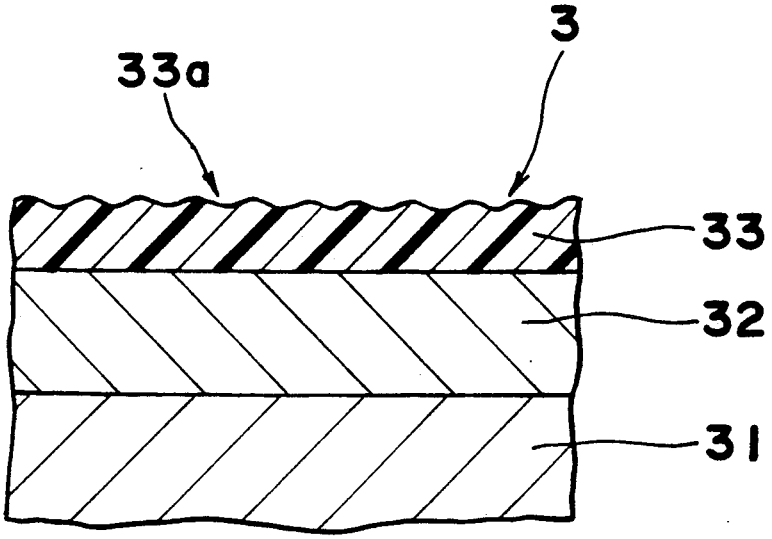
FIG. 3 shows a sectional view of a photosensitive member comprising a photoconductive layer on an electrically conductive substrate and an irregular surface protective layer on the photoconductive layer.

A photosensitive member (3) for electrophotography in this example concerns the third invention. The sectional view thereof is shown in FIG. 3. The photosensitive member is constituted of an electrically conductive substrate (31), a photoconductive layer (32) and a surface protective layer (33) with protuberances and hollows (33*a*) thereon, being different from that in Example 1 only in the protuberances and hollows on the surface protective layer. The protuberances and hollows (33*a*) were formed as follows: The surface protective layer was ground by abrasive grind wheel composed of diamond abrasive grains of #2000 at the revolution rate of 1000 m/min in circumferential velocity in a grinding machine (Hi-Gloss 450-H; made by Kondo Seisakusho K.K.).

The average roughness of obtained surface protective layer was 0.048 μm. The volume resistance of the surface protective layer was $10^{13}$ Ω cm. The saturated degree of water absorption of the used nylon copolymer was 2% in relative humidity of 65% at 24° C.

EXAMPLE 9

A photosensitive member for electrophotography in this example concerns the third invention, being different from that in Example 2 only in that the protuberances and follows are formed on the surface protective layer. The protuberances and follows were formed in a manner similar to Example 8, except that abrasive grind wheel composed of titania abrasive grains of #1000 was used in the grinding machine. The average roughness of the obtained surface protective layer was 0.067 μm. The volume resistance of the surface protective layer was $10^{13}$ Ω cm. The saturated degree of water absorption of the used nylon copolymer was 1.5% in relative humidity of 65% at 24 ° C.

EXAMPLE 10

A photosensitive member for electrophotography in this example concerns the third invention, being different from that in Example 3 only in that the protuberances and hollows are formed on the surface protective layer. The protuberances and hollows were formed in a manner similar to Example 8.

The average roughness of the obtained surface protective layer was 0.040 μm. The volume resistance of the surface protective layer was $10^{13}$ Ω cm. The saturated degree of water absorption of the used nylon copolymer was 2.0% in relative humidity of 65% at 24° C.

EXAMPLE 11

Figure 4:
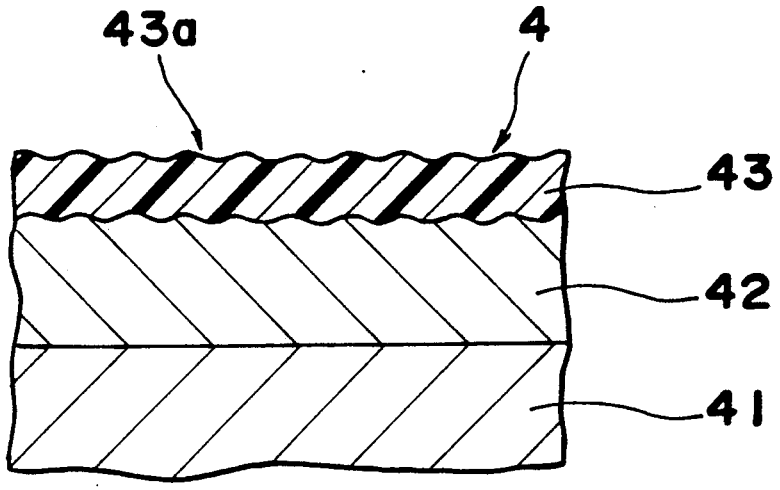
FIG. 4 shows a sectional view of a photosensitive member comprising an irregular photoconductive layer on an electrically conductive substrate and an irregular surface protective layer on the photoconductive layer.

A photosensitive member (4) for electrophotography in this example concerns the third invention. The sectional view thereof is shown in FIG. 4. The photosensitive member is constituted of an electrically conductive substrate (41), a photoconductive layer (42), the surface of which is made irregular, and a surface protective layer (43) with protuberances and hollows.

In this example, after the photoconductive layer (42) was formed in a manner similar to Example 1, it was ground to be made irregular, and then the surface protective layer was formed on the irregular photoconductive layer, resulting in the formation of the protuberances and hollows on the surface protective layer.

The grinding of the photoconductive layer (42) was carried out in a manner similar to Example 8.

The average roughness of the obtained surface protective layer was 0.048 μm. The volume resistance of the surface protective layer was $10^{13}$ Ω cm. The saturated degree of water absorption of the used nylon copolymer was 2% in relative humidity of 65% at 24° C.

EXAMPLE 12

A photosensitive member for electrophotography in this example concerns the third invention, being constituted of an electrically conductive substrate, a photoconductive layer, the surface of which is made irregular, and a surface protective layer with protuberances and hollows.

In this example, after the photoconductive layer was formed in a manner similar to Example 2, the photoconductive layer was ground to be made irregular, and then the surface protective layer was formed on the irregular photoconductive layer, resulting in the formation of the protuberances and hollows on the surface protective layer.

The grinding of the photoconductive layer was carried out in a manner similar to Example 9.

The average roughness of the obtained surface protective layer was 0.067 μm. The volume resistance of the surface protective layer was $10^{13}$ Ω cm. The saturated degree of water absorption of the used nylon copolymer was 1.5% in relative humidity of 65% at 24° C.

EXAMPLE 13

A photosensitive member for electrophotography in this example concerns the third invention, being constituted of an electrically conductive substrate, a photoconductive layer, the surface of which is made irregular, and a surface protective layer with protuberances and hollows.

In the example, after the photoconductive layer was formed in a manner similar to Example 3, it was ground to be made irregular, and then the surface protective layer was formed on the irregular photoconductive layer, resulting in the formation of the protuberances and hollows on the surface protective layer.

The grinding of the photoconductive layer (42) was carried out in a manner similar to Example 8.

The average roughness of the obtained surface protective layer was 0.040 μm. The volume resistance of the surface protective layer was $10^{13}$ Ω cm. The saturated degree of water absorption of used nylon copolymer was 2% in relative humidity of 65% at 24° C.

EXAMPLE 14

Figure 5:
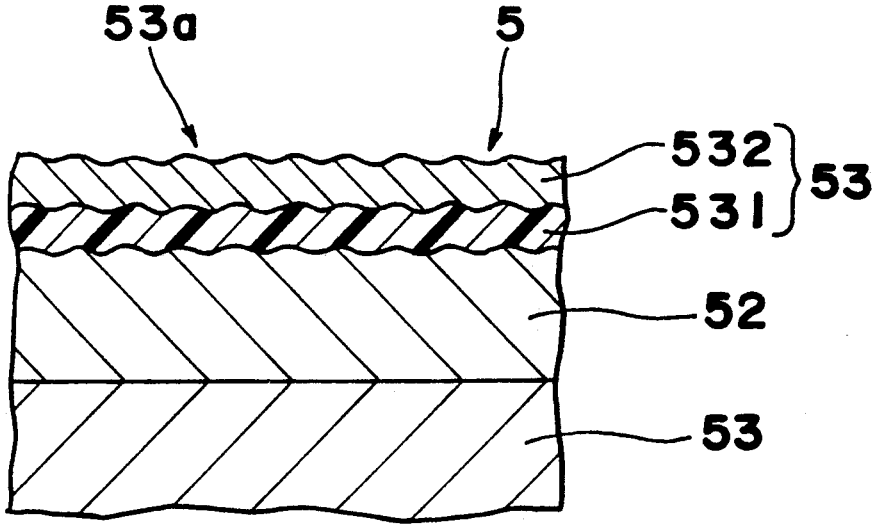
FIG. 5 shows a sectional view of a photosensitive member comprising an irregular photoconductive layer on an electrically conductive substrate and an irregular surface protective layer on the photoconductive layer, the surface protective layer comprising two irregular layers.

A photosensitive member for electrophotography (5) in this example concerns the fourth invention. The sectional view thereof is shown in FIG. 5. The photosensitive member is constituted of an electrically conductive substrate (51), a photoconductive layer (52), the surface of which is made irregular, and a surface protective layer composed of a first layer (531) and a second layer (532), protuberances and hollows(53*a*) being formed on the surface protective layer(53).

In this example, after the photoconductive layer (52) was formed in a manner similar to Example 4, it was ground to be made irregular and then the surface protective layer (53) was formed on the irregular photoconductive layer (52), resulting in the formation of the protuberances and hollows (53*a*) on the surface protective layer (53).

The grinding of the photoconductive layer (52) was carried out in a manner similar to Example 8.

The average roughness of the obtained surface protective layer (53) was 0.095 μm. The volume resistance of the surface protective layer was $10^{13}$ Ω cm. The saturated degree of water absorption of the used nylon copolymer was 2% in relative humidity of 65% at 24° C.

EXAMPLE 15

A photosensitive member for electrophotography in this example concerns the fourth invention, being constituted of an electrically conductive substrate, a photoconductive layer, the surface of which is made irregular, and a surface protective layer composed of a first layer, and a second layer, protuberances and hollows being formed on the surface protective layer.

In this example, after the photoconductive layer was formed in a manner similar to Example 5, it was ground to be made irregular and then the surface protective layer was formed on the irregular photoconductive layer, resulting in the formation of the protuberances and hollows on the surface protective layer.

The grinding of the photoconductive layer was carried out in a manner similar to Example 9.

The average roughness of the obtained surface protective layer was 0.088 μm. The volume resistance of the surface protective layer was $10^{13}$ Ω cm. The saturated degree of water absorption of the used nylon copolymer was 1.5% in relative humidity of 65% at 24° C.

EXAMPLE 16

A photosensitive member for electrophotography in this example concerns the fourth invention, being constituted of an electrically conductive substrate, a photoconductive layer, the surface of which is made irregular, and a surface protective layer composed of a first layer, and a second layer, protuberances and hollows being formed on the surface protective layer.

In this example, after the photoconductive layer was formed in a manner similar to Example 7, it was ground to be made irregular and then the surface protective layer was formed on the irregular photoconductive layer, resulting in the formation of the protuberances and hollows on the surface protective layer.

The grinding of the photoconductive layer was carried out in a manner similar to Example 8.

The average roughness of the obtained surface protective layer was 0.078 μm. The volume resistance of the surface protective layer was $10^{13}$ Ω cm. The saturated degree of water absorption of the used nylon copolymer was 2% in relative humidity of 65% at 24° C.

EXAMPLE 17

A photosensitive member for electrophotography in this example concerns the fourth invention, being constituted of an electrically conductive substrate, a photoconductive layer, the surface of which is made irregular, and a surface protective layer composed of a first layer and a second layer, protuberances and hollows being formed on the surface protective layer.

In this example, after the photoconductive layer was formed in a manner similar to Example 7, it was ground to be made irregular and then the surface protective layer was formed on the irregular photoconductive layer, resulting in the formation of the protuberances and hollows on the surface protective layer.

The grinding of the photoconductive layer was carried out in a manner similar to Example 8.

The average roughness of the obtained surface protective layer was 0.078 μm. The volume resistance of the surface protective layer was $10^{13}$ Ω cm. The saturated degree of water absorption of the used nylon copolymer was 2% in relative humidity of 65% at 24° C.

EXAMPLE 18

A photosensitive member was prepared in a manner similar to Example 1, except that four component nylon copolymer of nylon 6, nylon 66, nylon 11 and nylon 12 was used. The volume resistance of the surface protective layer was $10^{12}$Ω cm. The saturated degree of the used nylon copolymer was 4% in relative humidity of 65% at 24° C. The average roughness of the obtained surface protective layer was 0.015 μm.

COMPARATIVE EXAMPLE 1

A photosensitive member in this example is different from that of Example 1 only in the surface protective layer. The surface protective layer is the conventional one prepared with polyester amide. The polyester amide is prepared by copolymerizing polybutylene terephthalate of 50 parts by weight with undecanamide of 50 parts by weight. The surface protective layer was formed as follows; The polyester amide was dissolved in a mixed solvent of dimethylformamide and methanol (1:3) to be contained at the content of 10 percents by weight. The substrate with the photoconductive layer thereon, which was the same as that in Example 1, was dipped in the above obtained solution to form the surface protective layer on the photoconductive layer so that the thickness might be 2μm after dried.

COMPARATIVE EXAMPLE 2

A photosensitive member in this example is different from that of Example 2 only in the surface protective layer. The surface protective layer is the conventional one prepared with polyester amide. The polyester amide is prepared by copolymerizing polyisophthalate of 50 parts by weight with dodecanamide of 50 parts by weight. The surface protective layer was prepared as follows; The polyester amide was dissolved in a mixed solvent of trichloroethane and methanol (1:5) to be contained at the content of 12 percents by weights. The obtained solution was sprayed so that the surface protective layer might be 3 μm in thickness after dried.

EVALUATION

The photosensitive members obtained in Examples 1-17 and Comparative Examples 1 and 2, the constitutions of which are summarized in Table 1, were mounted in a copying machine (remodeled EP-550; made by Minolta Camera K.K.) to compare electrophotographic properties.

The photosensitive members were subjected to a conventional copying process in which a positive or negative corona charge process, a light-irradiation process, a developing process, a separating process and an erasing process were repeated, to measure charging potential, residual potential, copied image quality, decrease of layer thickness and initial torque of photosensitive members. In this evaluation the charging potential, residual potential and copied image quality were measured after the first copying process and after the coping process was repeated 200,000 times. The decrease of the layer thickness (μm ) was measured after the copying process was repeated 200,000 times. The results are shown in Table 2.

TABLE 1

| | | Surface protective layer | | | | |
|---|---|---|---|---|---|---|
| Ex. | Photoconductive layer | Nylon component | Saturated degree of water absorption | Curing agent | Second layer (inorganic compound) | Average roughness (μm) |
| First invention | | | | | | |
| 1 | α-SeAS | 6/66/12 | 2% (24° C.) | | | 0.014 |
| 2 | α-type cupper phthalocyanine | 6/66/Bis(4-aminocychlohexyl)methane 6 | 1.5% (24° C.) | Melamine resin | | 0.018 |
| 3 | α-SeAS | 6/66/12 | 2% (24° C.) | Epoxy resin Melamine resin | | 0.015 |
| 18 | α-SeAS | 6/66/11/12 | 4% (24° C.) | | | 0.015 |
| Second invention | | | | | | |
| 4 | α-SeAS | 6/66/12 | 2% (24° C.) | | SiC | 0.014 |
| 5 | α-type cupper phthalocyanine | 6/66/Bis(4-aminocychlohexyl)methane 6 | 1.5% (24° C.) | Melamine resin | $TiO_2$ | 0.018 |
| 6 | α-SeAS | 6/66/12 | 2% (24° C.) | Epoxy resin Melamine resin | SiC | 0.020 |
| 7 | α-SeAS | 6/66/10 | 2% (24° C.) | Epoxy resin Melamine resin | $Al_2O_3$ | 0.017 |
| Third invention | | | | | | |
| 8 | α-SeAS | 6/66/12 | 2% (24° C.) | | | 0.048 |
| 9 | α-type cupper phthalocyanine | 6/66/Bis(4-aminocychlohexyl)methane 6 | 1.5% (24° C.) | Melamine resin | | 0.067 |
| 10 | α-SeAS | 6/66/12 | 2% (24° C.) | Epoxy resin Melamine resin | | 0.040 |
| 11 | α-SeAS | 6/66/12 | 2% (24° C.) | | | |
| 12 | α-type cupper phthalocyanine | 6/66/Bis(4-aminocychlohexyl)methane 6 | 1.5% (24° C.) | Melamine resin | | 0.067 |
| 13 | α-SeAS | 6/66/12 | 2% (24° C.) | Epoxy resin Melamine resin | | 0.040 |
| Fourth invention | | | | | | |
| 14 | α-SeAS | 6/66/12 | 2% (24° C.) | | SiC | 0.095 |
| 15 | α-type cupper phthalocyanine | 6/66/Bis(4-aminocychlohexyl)methane 6 | 1.5% (24° C.) | Melamine resin | $TiO_2$ | 0.088 |
| 16 | α-SeAS | 6/66/12 | 2% (24° C.) | Epoxy resin Melamine resin | SiC | 0.092 |
| 17 | α-SeAS | 6/66/10 | 2% (24° C.) | Epoxy resin Melamine resin | $Al_2O_3$ | 0.078 |
| Conventional | | | | | | |
| Com. Ex. 1 | α-SeAS | | Polyester amide series | | | 0.018 |
| 2 | α-type cupper phthalocyanine | | Polyester amide series | | | 0.022 |

TABLE 2

| Ex. No. | Charging potential (V) Initial | Charging potential (V) After 200.000 times | Residual potential (V) Initial | Residual potential (V) After 200.000 times | Copied image quality Initial | Copied image quality After 200.000 times | Decrease of layer thickness (μm) | Initial revolution torque (kg · cm) |
|---|---|---|---|---|---|---|---|---|
| First invention | | | | | | | | |
| 1 | +600 | +620 | +50 | +80 | o | o-Δ | 0.82 | 6.4 |
| 2 | −600 | −630 | −80 | −110 | o | o | 0.48 | 6.2 |
| 3 | +600 | +630 | +60 | +80 | o | o | 0.40 | 6.2 |
| 18 | +600 | +620 | +40 | +80 | o | o-Δ | 0.92 | 6.3 |
| Second invention | | | | | | | | |
| 4 | +600 | +620 | +40 | +60 | o | o-Δ | 0.06 | 5.8 |
| 5 | −600 | −630 | −70 | −100 | o | o | 0.08 | 5.7 |
| 6 | +600 | +620 | +40 | +60 | o | o | 0.04 | 5.8 |
| 7 | +600 | +620 | +40 | +50 | o | o | 0.04 | 5.5 |
| Third invention | | | | | | | | |
| 8 | +600 | +630 | +60 | +80 | o | o-Δ | 0.79 | 5.5 |
| 9 | −600 | −640 | −70 | −100 | o | o | 0.37 | 5.4 |
| 10 | +600 | +630 | +50 | +70 | o | o | 0.34 | 5.5 |
| 11 | +600 | +620 | +50 | +80 | o | o-Δ | 0.78 | 5.5 |
| 12 | −600 | −630 | −80 | −110 | o | o | 0.44 | 5.0 |
| 13 | +600 | +630 | +60 | +80 | o | o | 0.38 | 5.6 |
| Fourth invention | | | | | | | | |
| 14 | +600 | +620 | +40 | +60 | o | o-Δ | 0.05 | 4.7 |
| 15 | −600 | −630 | −70 | −100 | o | o | 0.06 | 4.7 |
| 16 | +600 | +620 | +40 | +60 | o | o | 0.04 | 4.6 |
| 17 | +600 | +630 | +40 | +60 | o | o | 0.03 | 4.5 |
| Conventional | | | | | | | | |
| Com. Ex. 1 | +600 | +670 | +80 | +140 | o-Δ | x | 1.4 | 6.7 |
| 2 | −600 | −690 | −100 | −170 | o-Δ | x | 1.7 | 7.3 |

The symbols "o", "Δ" and "x" in the item to the copied images means as follows:

o: good copied image quality

Δ: a little lowered in copied image quality in comparison with those at initial stage.

x: lowered in copied image quality in comparison with those at initial stage.

As shown in Table 2, in the each case of photosensitive members of Comparative Example 1 and 2, there was an increase of 79–90 V in charging potential and an increase of 60–70 V in residual potential after the copying process was repeated 200,000 times.

With respect to copied image quality, there are observed flows in copied images after 200,000 times of copying process. Further, there was a decrease of 1.4 μm or more in layer thickness after 200,000 times of copying process. It was understood that the wear resistance was not good.

On the other hand, the photosensitive members obtained in Examples 1–17 were stable in charging potential even after the copying process was repeated 200,000 times, and there was a small increase (30 V or less) of residual potential. Further it was also confirmed that the photosensitive members of the present inventions were excellent in humidity resistance because flows of copied images were not observed after 200,000 times of copying process.

The decrease of the layer thickness of photosensitive members of the present invention was 0.82 μm or less. Therefore, it was confirmed that the photosensitive member of the present invention was excellent in wear resistance. In particular, the photosensitive members with the surface protective layers of laminated types were very excellent in wear resistance.

The initial revolution torque was lowered to 6.4 Kg·cm or less. In particular, the photosensitive members with the irregular outer most surface formed of inorganic materials obtained in Examples 4–7 and 14–17 were very excellent. With respect to the initial revolution torque, it was also confirmed that the revolution torque decreased so far as the outermost surface of the photosensitive member had irregularities of 0.03–0.3 μm in average roughness even though the composition and structure of photosensitive members were same.

The photosensitive members obtained in Examples 4–7, 14–17 in which the outermost surface protective layers were irregular and formed of inorganic materials show low revolution torque of about 4.5–5.5 kg.cm.

What is claimed is:

1. A photosensitive member for electrophotography with a photoconductive layer on an electrically conductive substrate and a surface protective layer on the photoconductive layer, wherein the surface protective layer comprises;

a first layer having a thickness of 0.05–2.0 μm comprising a copolymer which includes at least three nylon monomer components including at least a monomer component for 6-nylon and a monomer component for 6,6-nylon, said copolymer having 0.5–10% in saturated degree of water absorption under 65% of relative humidity at 24° C. and a second layer having a thickness of 0.05–2.0 μm formed on the first layer comprising an inorganic compound.

2. A photosensitive member of claim 1, wherein the copolymer further comprises one or more monomer components of nylons selected from the group consisting of a monomer component for nylon-610, a monomer component for nylon-11, a monomer component for nylon-12, a monomer component for nylon-7 a monomer component for nylon-9 and a monomer component for bis(4-aminocyclohexyl)methane-6.

3. A photosensitive member of claim 1, wherein the inorganic compound has $10^9$ ohm cm or more in volume resistance.

4. A photosensitive member for electrophotography with a photoconductive layer on an electrically conductive substrate and a surface protective layer on the photoconductive layer, wherein the surface protective layer comprises;

a first layer having a thickness of 0.05–2.0 μm comprising a copolymer which includes at least three nylon monomer components including at least a monomer component for 6-nylon and a monomer component for 6,6-nylon, said copolymer having 0.5–10% in saturated degree of water absorption under 65% of relative humidity at 24° C. and a second layer having a thickness of 0.05–2.0 μm formed on the first layer comprising inorganic compounds and having protuberances and hollows thereon of 0.03–0.30 micron m in average roughness.

5. A photosensitive member of claim 4, wherein the copolymer further comprises one or more monomer components of nylons selected from the group consisting of a monomer component for nylon-610, a monomer component for nylon-11, a monomer component for nylon-12, a monomer component for nylon-7 a monomer component for nylon-9 and a monomer component for bis(4-aminocyclohexyl)methane-6.

6. A photosensitive member of claim 4, wherein the interfacial surface between the photosensitive layer and the surface protective layer is made rough.

* * * * *